US011134750B2

(12) United States Patent
Li

(10) Patent No.: US 11,134,750 B2
(45) Date of Patent: Oct. 5, 2021

(54) INFLATABLE SHOCK-ABSORBING SOLE STRUCTURE

(71) Applicants: Zhejiang Geely Holding Group Co., Ltd., Hangzhou (CN); Zhejiang Geely Automobile Research Institute Co., Ltd., Linhai (CN)

(72) Inventor: Shufu Li, Hangzhou (CN)

(73) Assignees: ZHEJIANG GEELY HOLDING GROUP CO., LTD., Zhejiang Province (CN); ZHEJIANG GEELY AUTOMOBILE RESEARCH INSTITUTE CO., LTD., Zhejiang Province (CN)

( * ) Notice: Subject to any disclaimer, the term of this patent is extended or adjusted under 35 U.S.C. 154(b) by 264 days.

(21) Appl. No.: 16/085,539

(22) PCT Filed: Mar. 7, 2017

(86) PCT No.: PCT/CN2017/075878
§ 371 (c)(1),
(2) Date: Sep. 14, 2018

(87) PCT Pub. No.: WO2018/028189
PCT Pub. Date: Feb. 15, 2018

(65) Prior Publication Data

US 2020/0297073 A1 Sep. 24, 2020

(30) Foreign Application Priority Data

Aug. 8, 2016 (CN) ..... 201610642634.6

(51) Int. Cl.
*A43B 13/20* (2006.01)
*A43B 3/00* (2006.01)
(Continued)

(52) U.S. Cl.
CPC ..... *A43B 13/203* (2013.01); *A43B 3/0005* (2013.01); *A43B 13/206* (2013.01);
(Continued)

(58) Field of Classification Search
CPC ..... A43B 13/20; A43B 13/203; A43B 13/206; A43B 13/36; A43B 13/28; A43B 13/285; A43B 3/0005
See application file for complete search history.

(56) References Cited

U.S. PATENT DOCUMENTS 1,344,972 A * 6/1920 Armour ..... A43C 13/04 36/59 A
4,071,963 A 2/1978 Fukuoka
(Continued)

FOREIGN PATENT DOCUMENTS

CN 2076769 U 5/1991
CN 101856161 A 10/2010
(Continued)

*Primary Examiner* — Ted Kavanaugh
(74) *Attorney, Agent, or Firm* — Cheng-Ju Chiang

(57) ABSTRACT

The present disclosure provides an inflatable shock-absorbing sole structure, which includes a sole and at least one convex arranged on the sole, an airbag room is formed in the convex, and an airbag is arranged in the airbag room, the airbag room and the airbag are stretchable and compressible. The shock-absorbing sole structure further includes a built-in air-charging device, when the airbag needs to be inflated, the air-charging device can inflate it. The present disclosure provides a shock-absorbing sole structure, the airbag room and the airbag form a shock absorption system in the sole structure, which endows the sole structure a better shock absorption effect. Further, by mounting a built-in air-charging device in the sole structure, when the air bag needs to be inflated, the built-in air-charging device can inflate it.

14 Claims, 12 Drawing Sheets

(51) Int. Cl.

| | |
|---|---|
| ***A43B 13/24*** | (2006.01) |
| ***A43B 13/36*** | (2006.01) |
| ***A43B 21/28*** | (2006.01) |

(52) U.S. Cl.
CPC ..... *A43B 13/24* (2013.01); *A43B 13/36* (2013.01); *A43B 21/285* (2013.01)

(56) References Cited

U.S. PATENT DOCUMENTS

| | | | | |
|---|---|---|---|---|
| 4,267,650 | A * | 5/1981 | Bauer | A43B 13/36 36/101 |
| 4,782,603 | A * | 11/1988 | Brown | A43B 13/181 36/28 |
| 5,222,312 | A * | 6/1993 | Doyle | A43B 13/203 36/28 |
| 5,253,435 | A * | 10/1993 | Auger | A43B 5/00 36/114 |
| 5,813,142 | A | 9/1998 | Demon | |
| 7,249,428 | B1 * | 7/2007 | Burella | A43B 3/0078 36/134 |
| 2005/0066543 | A1 * | 3/2005 | Rosen | A43B 3/18 36/7.5 |
| 2005/0229432 | A1 | 10/2005 | Lo | |
| 2005/0252038 | A1 * | 11/2005 | Braunschweiler | A43B 3/246 36/28 |
| 2007/0129907 | A1 * | 6/2007 | Demon | A43B 3/0005 702/127 |
| 2009/0013561 | A1 | 1/2009 | Robinson, Jr. et al. | |
| 2011/0047817 | A1 | 3/2011 | Francello et al. | |
| 2012/0090200 | A1 * | 4/2012 | Cook | A43B 3/246 36/103 |
| 2012/0222332 | A1 * | 9/2012 | Greene | A43B 13/122 36/103 |
| 2014/0165427 | A1 * | 6/2014 | Molyneux | A43B 21/26 36/102 |
| 2014/0215849 | A1 | 8/2014 | Litchfield et al. | |
| 2015/0230549 | A1 * | 8/2015 | Bernhard | A43B 13/223 36/25 R |

FOREIGN PATENT DOCUMENTS

| | | | |
|---|---|---|---|
| CN | 202262499 | U | 6/2012 |
| CN | 203182525 | U | 9/2013 |
| CN | 203841186 | U | 9/2014 |
| CN | 104126984 | A | 11/2014 |
| CN | 204232393 | U | 4/2015 |
| CN | 204617198 | U | 9/2015 |
| CN | 204682673 | U | 10/2015 |
| CN | 105188448 | A | 12/2015 |
| CN | 204838233 | U | 12/2015 |
| CN | 205180516 | U | 4/2016 |
| CN | 105661742 | A | 6/2016 |
| CN | 205306122 | U | 6/2016 |
| CN | 106213654 | A | 12/2016 |
| CN | 106263256 | A | 1/2017 |
| DE | 3530397 | A1 | 3/1987 |
| EP | 1882421 | A2 | 1/2008 |
| EP | 2954769 | A1 | 12/2015 |
| JP | S61-144804 | U | 9/1986 |
| JP | H8-501958 | A | 3/1996 |
| JP | 2003-530913 | A | 10/2003 |
| JP | 2005-506862 | A | 3/2005 |
| JP | 2007-501096 | A | 1/2007 |
| JP | 2008-504857 | A | 2/2008 |
| JP | 2008-229336 | A | 10/2008 |
| JP | 2009-142705 | A | 7/2009 |
| JP | 2010-75332 | A | 4/2010 |
| JP | 2014-87585 | A | 5/2014 |
| KR | 100552090 | B1 | 2/2006 |
| KR | 20130126774 | A | 11/2013 |
| WO | 97/15206 | A1 | 5/1997 |
| WO | 2004/105530 | A1 | 12/2004 |
| WO | 2016/022640 | A1 | 2/2016 |

* cited by examiner

INFLATABLE SHOCK-ABSORBING SOLE STRUCTURE

CROSS REFERENCE TO RELATED APPLICATION

The present application is a 35 U.S.C. § 371 National Phase conversion of International (PCT) Patent Application No. PCT/CN2017/075878, filed on Mar. 7, 2017, which is based on and claims priority of Chinese patent application No. 201610642634.6, filed on Aug. 8, 2016. The entire disclosure of the above-identified application, including the specification, drawings and claims are incorporated herein by reference in its entirety. The PCT International Patent Application was filed and published in English.

FIELD OF THE INVENTION

The present disclosure relates to a footgear field, particularly relates to an inflatable shock-absorbing sole structure.

BACKGROUND OF THE INVENTION

With the improvement of living standards, more and more people begin to think much of their health and exercises. As one of the most popular exercises, running is gradually changing people's daily leisure life. With the national rise of marathon fever, more and more young people, even middle-aged and old people, have joined the running movement, which makes the social penetration rate increasing year by year. However, running may also bring harm to one's knees or ankles. Once the harm occurred, it may take one week or even longer for the runner to recover, which will further cause physiological and psychological damages to him.

A shoe is mainly constituted by a vamp and a sole. When in use, the sole directly contacts with the ground, whether the shoe is comfortable or not mainly depends on the sole, because it is directly subjected to a friction from the ground, and simultaneously conveys a reacting stress from the ground to one's feet. Therefore, sufficient shock-absorbing is necessary for the sole, since it effectively protects one's feet and reduces fatigue feeling, and further avoids any injury brought by exercise impact, and facilitates to realize exercise or competitive sports.

Hence, a sneaker with an air-cushion was first invented in order to reduce the impact of severe exercise to one's joints. In such sneaker, the air-cushion was sandwiched between a shoe insert and the sole in order to buffer the impact loading from the sole to one's feet. In daily exercises, it is necessary that the pressure and hardness of the air-cushion can be adjusted to adapt to different situations. For example, the air-cushion is better to be soft when one is having a walk, and it is better to be hard when one is walking on soft grass. However, current air-cushion sneaker fails to or is not convenient to adjust the pressure and the hardness of the air-cushion. In view of the above, an inflatable shock-absorbing sole structure appears to be more practical and efficient.

SUMMARY OF THE INVENTION

The present disclosure provides an inflatable shock-absorbing sole structure, which includes a built-in air-charging device. When the airbag needs to be inflated, the air-charging device can inflate it. In this way, the pressure and the hardness of the airbag is easy to be adjusted in order to adapt to different road situations, and to improve wearing comfort.

In one embodiment of the present disclosure, an inflatable shock-absorbing sole structure is provided, which includes a sole and at least one protrusion arranged in the sole, an airbag room is formed in the protrusion, and an airbag is mounted in the airbag room, the airbag room and the airbag are stretchable and compressible, the shock-absorbing sole structure further includes a built-in air-charging device, when the airbag needs to be inflated, the air-charging device can inflate it.

In one embodiment, the air-charging device is a manual air-charging device which includes an air-charging button, the air-charging button is elastic, and the airbag can be manually inflated by operating the air-charging button.

In one embodiment, the air-charging button is exposed at one side of the shock-absorbing sole structure, or mounted under the sole part.

In one embodiment, the manual air-charging device further includes a first air pipe, a second air pipe, a first valve mounted in the first air pipe, and a second valve mounted in the second air pipe, the second air pipe connects the air-charging button and the airbag, and the first air pipe connects with the second air pipe and the external environment.

In one embodiment, the air-charging device is an automatic air-charging device, the shock-absorbing sole structure further includes a RF transceiver/receiver module and a controller, the controller connects with the air-charging device and the RF transceiver/receiver module. When the RF transceiver/receiver module receives an inflation instruction sent from a mobile terminal, the controller controls the air-charging device to automatically inflate the airbag.

In one embodiment, the automatic air-charging device includes a gas generator, the controller controls the gas generator to generate gas and automatically inflate the airbag.

In one embodiment, the airbag connects with an air vent, and an electronic-controlled sealing valve is mounted in the air vent, the sealing valve connects with the controller. When the RF transceiver/receiver module receives a deflation instruction sent from a mobile terminal, the controller controls the sealing valve to open in order to release extra gas from the airbag.

In one embodiment, the shock-absorbing sole structure further includes a pressure sensor used for detecting the gas pressure in the airbag.

In one embodiment, the shock-absorbing sole structure further includes a RF transceiver/receiver module, which is used for sending the air pressure value in the airbag detected by the air pressure sensor to the mobile terminal.

In one embodiment, the shock-absorbing sole structure further includes a controller which connects with the RF transceiver/receiver module, the controller provides suggested air pressure of the airbag according to the operating condition or the road condition, and sends the suggested air pressure to the mobile terminal of the user via the RF transceiver/receiver module.

In one embodiment, the airbag connects with an air vent, which is used to inflate the airbag or release extra gas from the airbag.

In one embodiment, there are multiple protrusions, and every two protrusions are arranged in a row along the left-to-right direction of the sole, and airbags in every two protrusions in each row connects with each other via a connecting tube.

In one embodiment, the shock-absorbing sole structure further includes a shoe insert mounted on the sole, and a connecting tube groove is arranged in the bottom surface of the shoe insert, the connecting tube groove is used to contain the connecting tube.

In one embodiment, a connecting tube groove is arranged in the upper surface of the sole, the connecting tube groove is used to contain the connecting tube.

In one embodiment, the multiple protrusions are separated from each other by spaces.

In one embodiment, the multiple protrusions are merely distributed at the heel part of the sole.

In one embodiment, the multiple protrusions are distributed at both the heel part and the forefoot part of the sole.

In one embodiment, an anti-wear block, which is removable and matches with the protrusion, is mounted on the bottom surface of the protrusion near the ground.

In one embodiment, the anti-wear block includes an anti-wear pad and fixing fins, the anti-wear pad contacts with the ground and the fixing fins are placed at the periphery of the anti-wear pad and contact with the anti-wear pad, the anti-wear block is removably fixed onto the protrusion via the fixing fins.

The shock-absorbing sole structures provided by the above embodiments of the present disclosure at least have the following advantages: the airbag room and the airbag mounted in the sole structure constitute a shock-absorbing system, which endows the sole structure a better shock absorption effect. Further, by mounting an air-charging device in the sole structure, when the air pressure in the airbag is insufficient, the airbag can be inflated through the built-in air-charging device. In this way, the air pressure and hardness of the airbag can be adjusted at any time in order to adapt to different road conditions and improve the wear comfort.

Next, two airbags in each row connect with each other via a connecting tube, which can effectively prevent the sole from rollover and even prevent spraining one's ankles when stepping onto uneven roads.

Then, by setting a removable anti-wear block on the sole, a modular sole structure is formed, when the anti-wear block is worn out, a new anti-wear block can be replaced. In this way, the user can fine adjust his walking posture timely, and thus reduce the worn out of the sole structure. Because of this, the life-span of the shoes is prolonged, and the undesirable walking posture caused by the worn out of the sole can be avoided; by replacing the removable anti-wear block, the user will not have to frequently replace new shoes and economic loss is avoided.

BRIEF DESCRIPTION OF THE DRAWINGS

The above objects and advantages of the present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Embodiment 1

Figure 1:
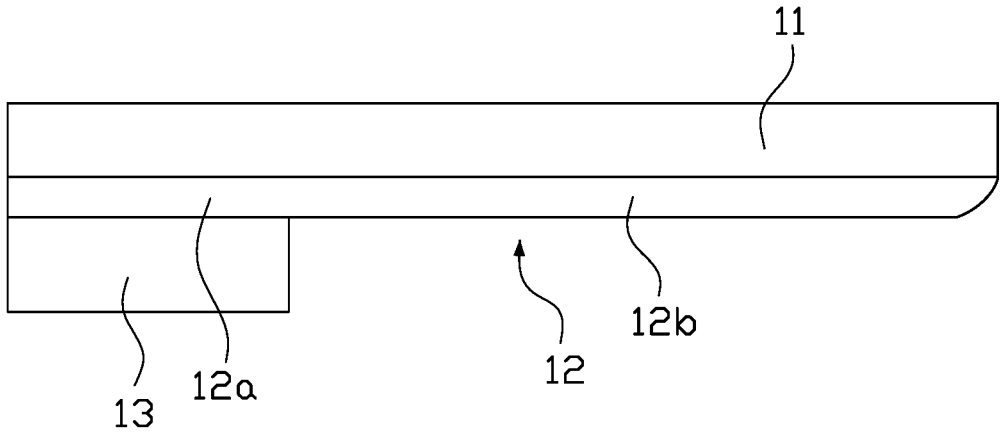
FIG. 1 illustrates a front view of the sole structure in embodiment 1 of the present disclosure.
Figure 2:
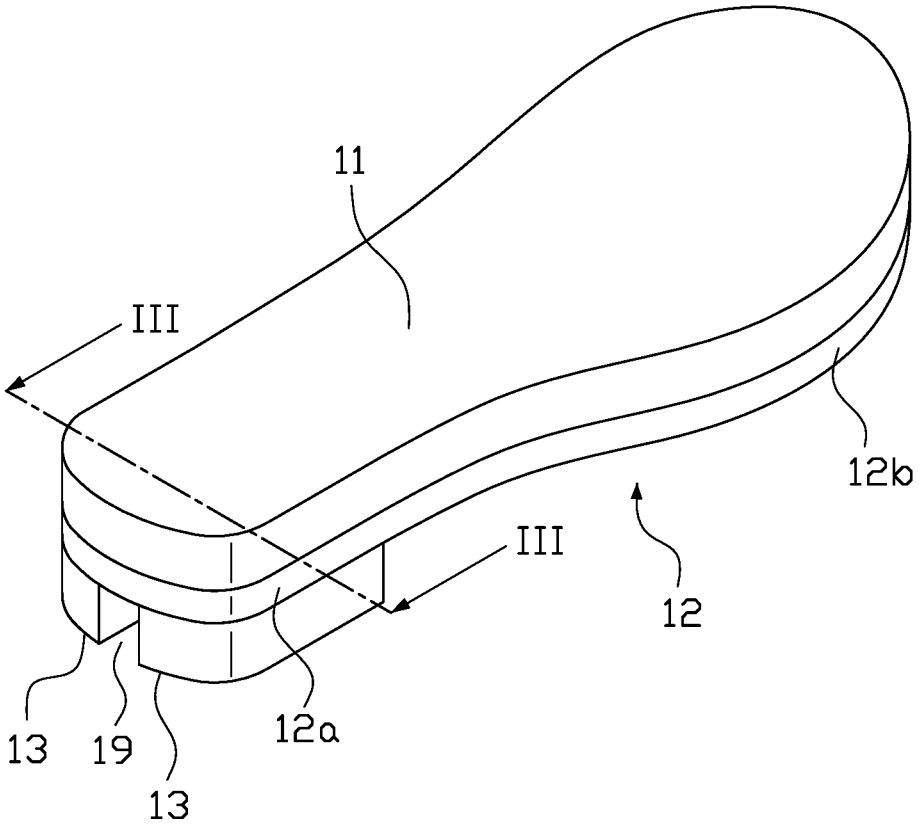
FIG. 2 is an assembled isometric view of the sole structure in FIG. 1.

FIG. 1 illustrates a front view of the sole structure in embodiment 1 of the present disclosure, and FIG. 2 is an assembled isometric view of the sole structure in FIG. 1. Please referring to FIGS. 1 and 2, the sole structure in this embodiment includes a shoe insert 11 and a sole 12, at least one protrusion 120 is arranged on the sole 12, and a removable anti-wear block 13 is mounted on the bottom surface of the protrusion 120 near the ground, which adapts to the protrusion 120. The shoe insert 11 is placed on the sole 12, and it can also be omitted according to actual situations.

FIGS. 3*a*-3*e* are cross sectional views of FIG. 2 along direction. Please referring to FIGS. 3*a*-3*e*, the anti-wear block 13 includes an anti-wear pad 131 and fixing fins 132, the anti-wear pad 131 contacts with the ground and the fixing fins 132 are placed at the periphery of the anti-wear pad 131 and connected with the anti-wear pad 131, the anti-wear block 13 is removably fixed onto the protrusion 120 via the fixing fins 132. More concretely, there is no limitation to the shape of the protrusion 120, which can be circular, elliptical, square or irregular. The shape of the anti-wear block 13 matches with that of the protrusion 120, the anti-wear block 13 is removably mounted on the bottom surface of the protrusion 120 near the ground. There is no limitation to the type that the anti-wear block 13 mounts to the protrusion 120, it can be plug-in, clip connection, threaded connection, or screw lock, etc., any method that facilitates the anti-wear block 13 to be removable to the protrusion 120 can work here.

Figure 3A:
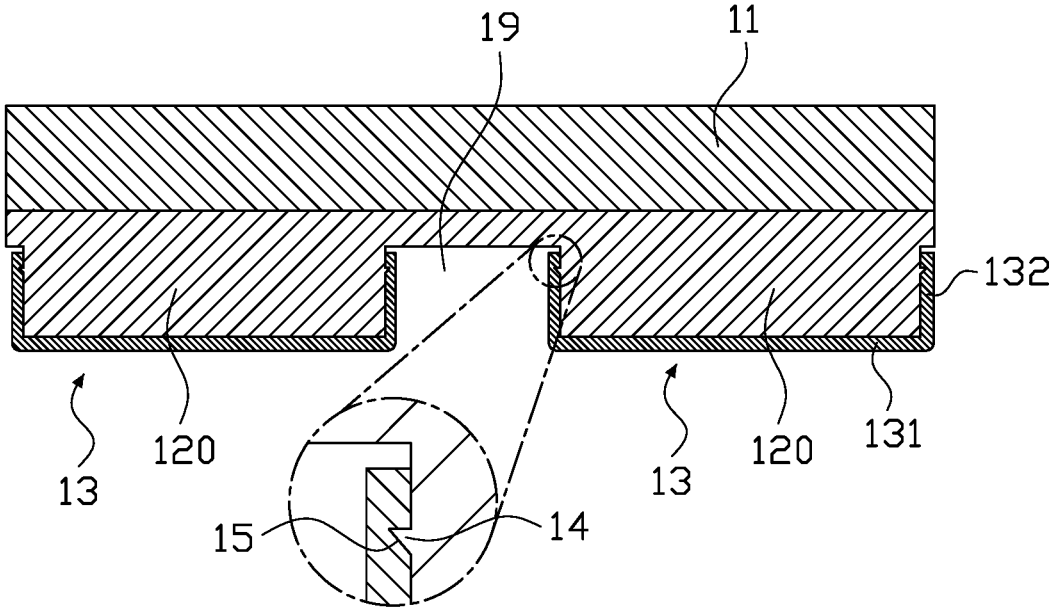
FIGS. 3*a*-3*e* are cross-sectional views in different samples along direction shown in FIG. 2.

For example, please referring to FIG. 3*a*, a snap-fit 14 is formed on either the outer surface of the protrusion 120 or the inner surface of the fixing fin 132, a slot 15 is formed in the other one of the outer surface of the protrusion 120 and the inner surface of the fixing fin 132, and the snap-fit 14 is removably clip-fixed in the slot 15. In one embodiment, the snap-fit 14 is formed on the outer surface of the protrusion 120, and the slot 15 is formed in the inner surface of the fixing fin 132. In another embodiment, the snap-fit 14 is formed on the inner surface of the fixing fin 132, and the slot 15 is formed in the outer surface of the protrusion 120.

Figure 3B:
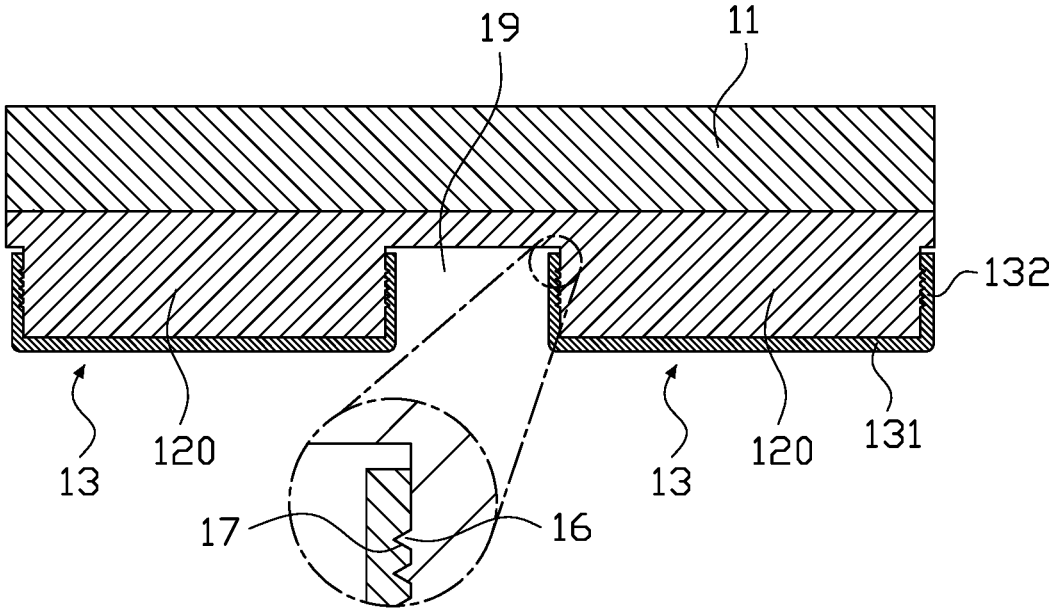

Please referring to FIG. 3*b*, external thread 16 is arranged in the outer surface of the protrusion 120, and internal thread 17 is arranged in the inner surface of the fixing fin 132, the internal thread 17 and the external thread 16 are in threaded connection, in this way, the anti-wear block 13 is removably mounted to the protrusion 120.

Figure 3C:
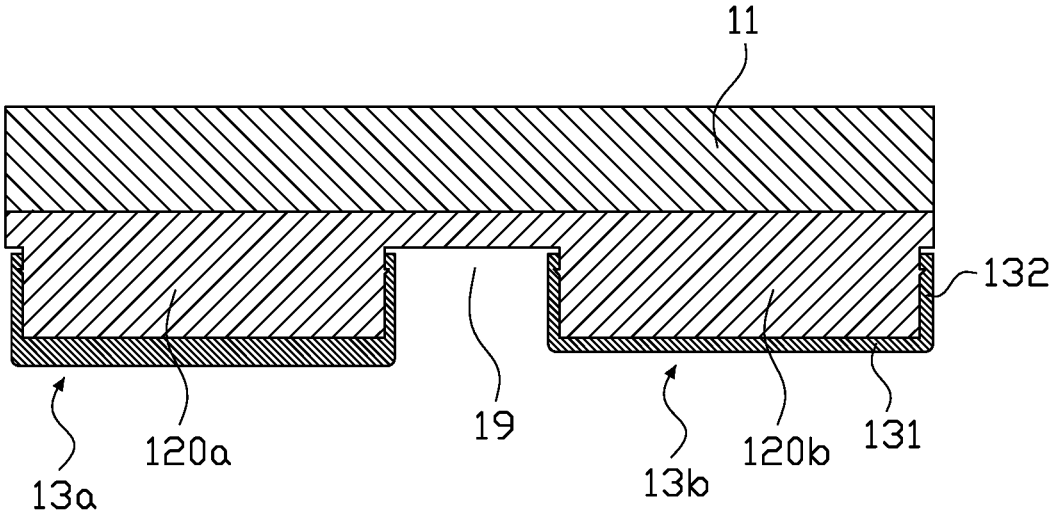
Figure 3D:
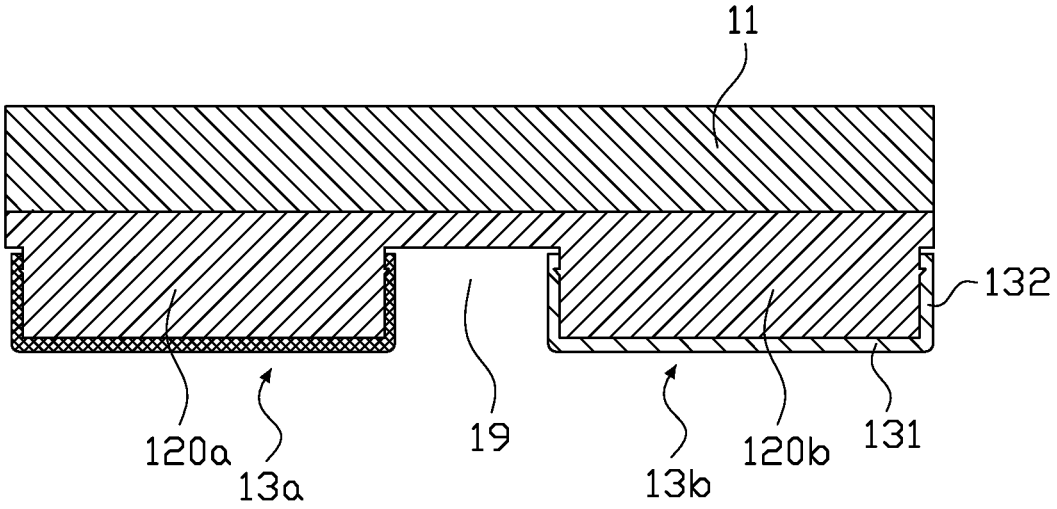

Please referring to FIGS. 3*c* and 3*d*, there are at least two protrusions 120 in the sole structure, the protrusions 120 includes a first protrusion 120*a* and a second protrusion 120*b*, an anti-wear block 13*a* is removably mounted onto the first protrusion 120*a*, and an anti-wear block 13*b* is removably mounted onto the second protrusion 120*b*, wherein a thickness of the anti-wear pad 131 of the first anti-wear block 13*a* is larger than that of the anti-wear pad 131 of the second anti-wear block 13*b* (as shown in FIG. 3*c*); or the wear resistance of the anti-wear pad 131 of the first anti-wear block 13*a* is better than that of the anti-wear pad 131 of the second anti-wear block 13*b* (as shown in FIG. 3*d*). In one embodiment, in order to realize that the wear resistance of the first anti-wear block 13*a* is better than that of the second anti-wear block 13*b*, a material of the first anti-wear block 13*a* can be different from that of the second anti-wear block 13*b*. Considering that different users have different walking habit, for some users, one side of the sole may be worn out more quickly than the other side. In this embodiment, to mount the anti-wear block that is thicker or has better wear resistance at the side which generally wore out more quickly than the other side can ensure the wear-out degree on both sides to be consistent, and can effectively improve the non-consistent wearing problems of both sides.

Figure 3E:
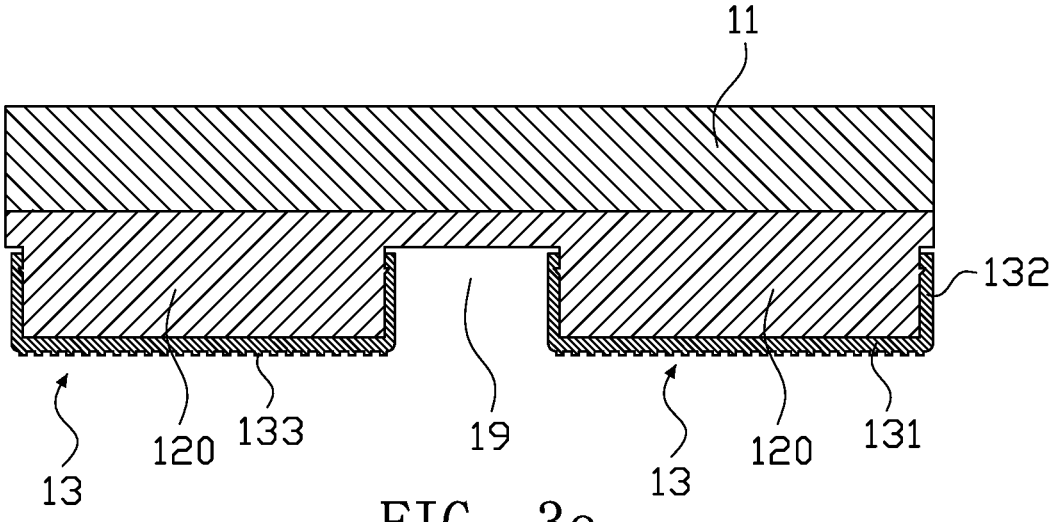

Please referring to FIG. 3*e*, the anti-wear block 13 further includes an anti-slip strip 133 mounted on the bottom of the anti-wear pad 131. The anti-slip strip 133 can be replaced by anti-slip cleats, in order to improve the wear resistance of the anti-wear block 13, or transform a normal shoe to an athletic shoe, such as golf shoes.

A material of the anti-wear block 13 can be different according to actual situations, such as metal, synthetic plastics or rubber, in order to match with different sports environment.

The protrusion 120 can be one or multiple. In the embodiment, there are multiple protrusions 120, the multiple protrusions 120 are separated from each other by spaces 19, and a removable anti-wear block 13 is mounted on the bottom of each of the protrusions 120, which matches with the protrusion 120. Each of the protrusions 120 is separated by the space 19, in this way, each of the protrusions 120 can independently contact with the ground.

Embodiment 2

Figure 4:
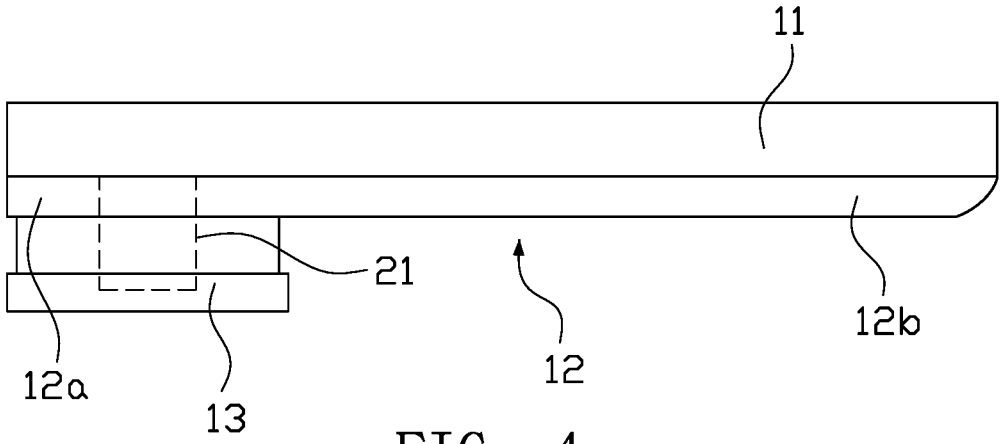
FIG. 4 is a front view of the sole structure in embodiment 2 of the present disclosure.
Figure 5:
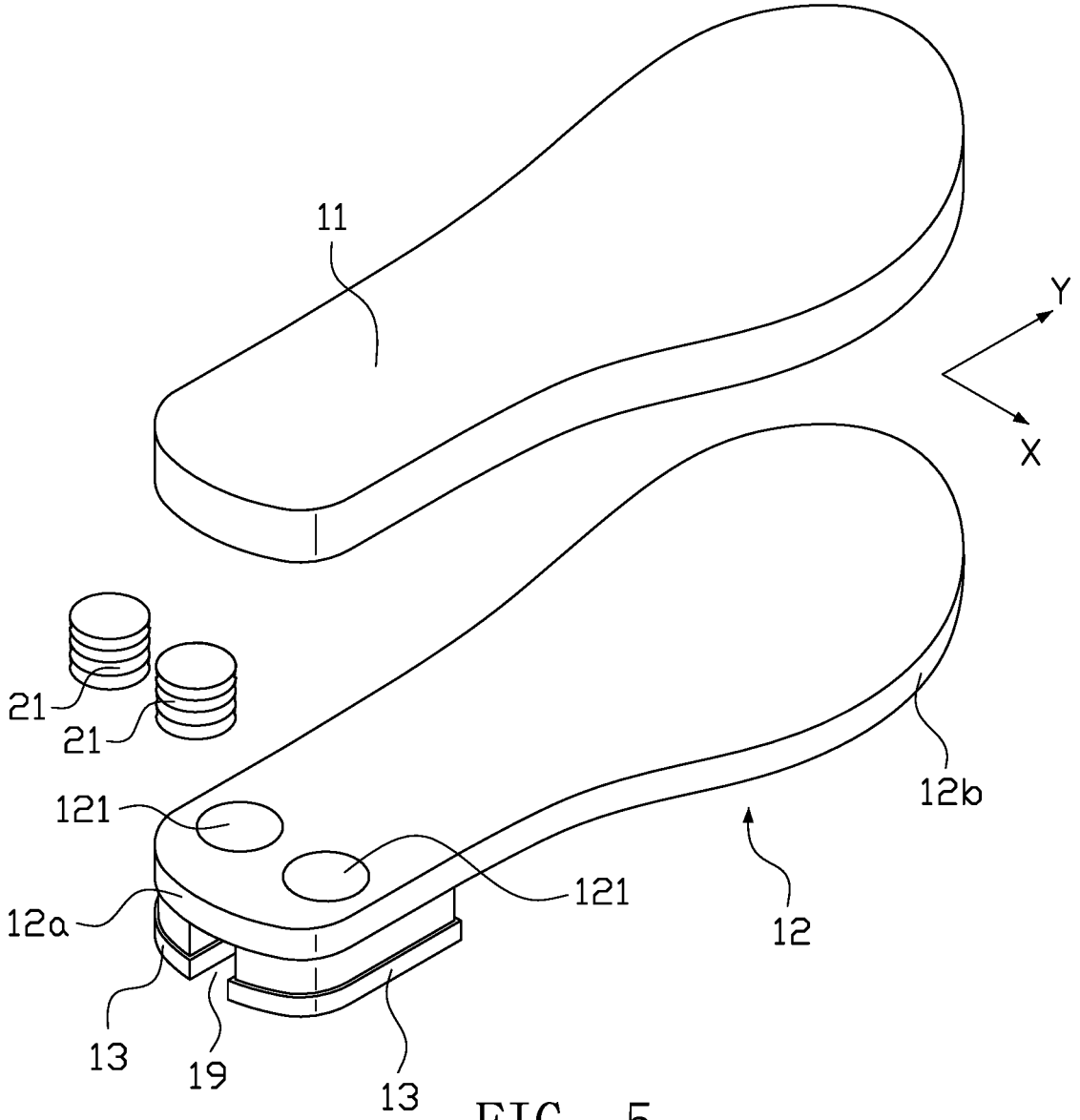
FIG. 5 is an exploded schematic view of the sole structure in FIG. 4.
Figure 6:
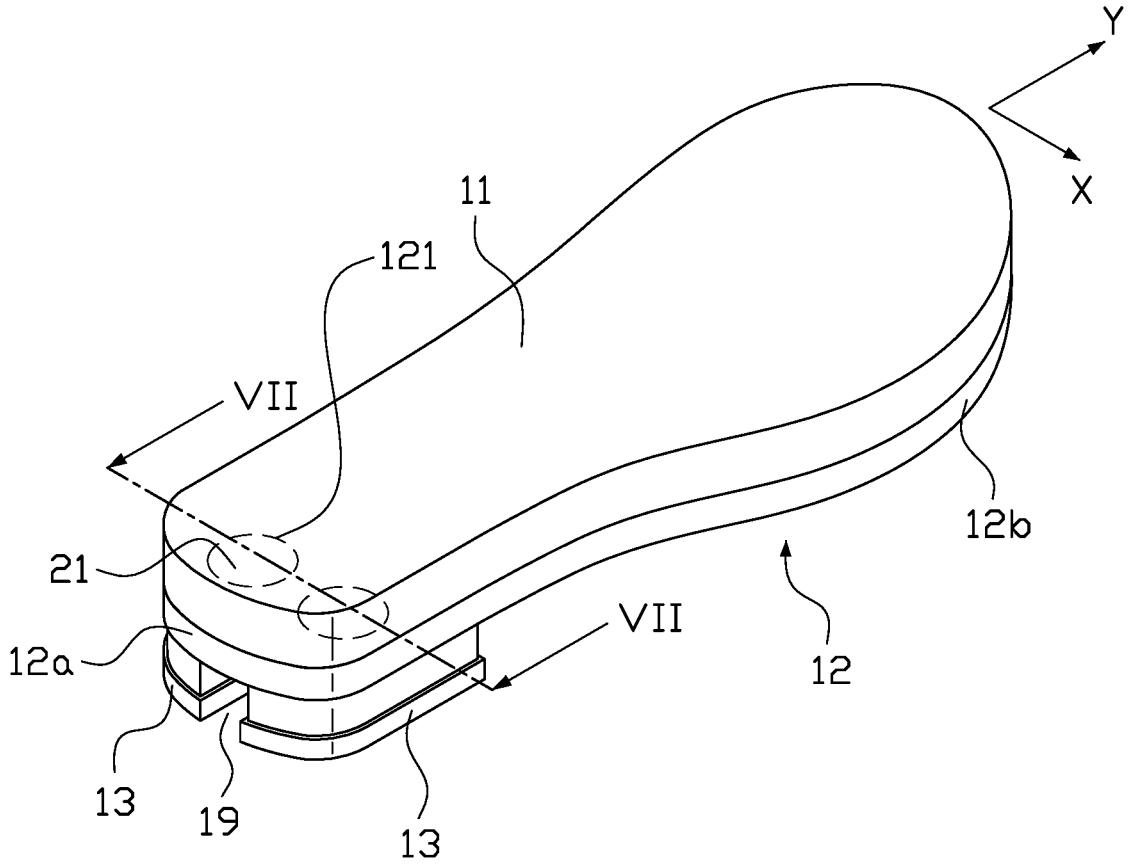
FIG. 6 is an assembled isometric view of the sole structure in FIG. 4.
Figure 7:
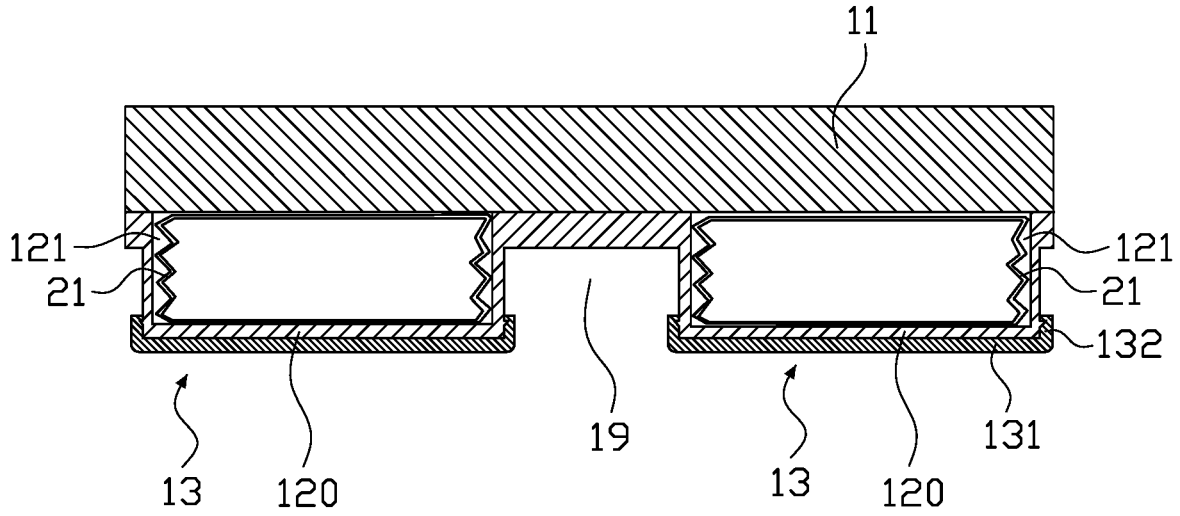
FIG. 7 is a cross-sectional view of FIG. 6 along VII-VII direction.

FIG. 4 is a front view of the sole structure in embodiment 2 of the present invention, FIG. 5 is an exploded schematic view of the sole structure in FIG. 4, FIG. 6 is an assembled schematic view of the sole structure in FIG. 4, and FIG. 7 is a cross-sectional view of FIG. 6 along VII-VII direction. Please referring to FIGS. 4-7, in this embodiment, an airbag room 121 is formed in the protrusion 120, and an airbag 21 is arranged in the airbag room 121, the airbag room 121 and the airbag 21 are stretchable and compressible. The airbag room 121 and the airbag 21 can be mounted in some of the protrusions 120 or be mounted in all of the protrusions 120. The arrangement of the airbag room 121 and the airbag 21 in the protrusion 120 can effectively improve the shock absorption effect of the sole structure. Further, compared with the solution wherein merely airbag room 121 is arranged, the embodiment wherein the airbag 21 is arranged in the airbag room 121 greatly reduces the leakage risk of the airbag 21. Even the shoe-insert 11 and the sole 12 are not combined closely, which leads to the leakage of the airbag room 121, the air tightness of the airbag 21 will not be affected. Since the airbag room 121 is stretchable and compressible, the anti-wear block 13 cannot be extremely high; generally, it is slightly higher than the bottom of the airbag room 121. That is to say, compared with the first embodiment, the height of the anti-wear block 13 is less than that in embodiment 1.

Embodiment 3

Figure 8:
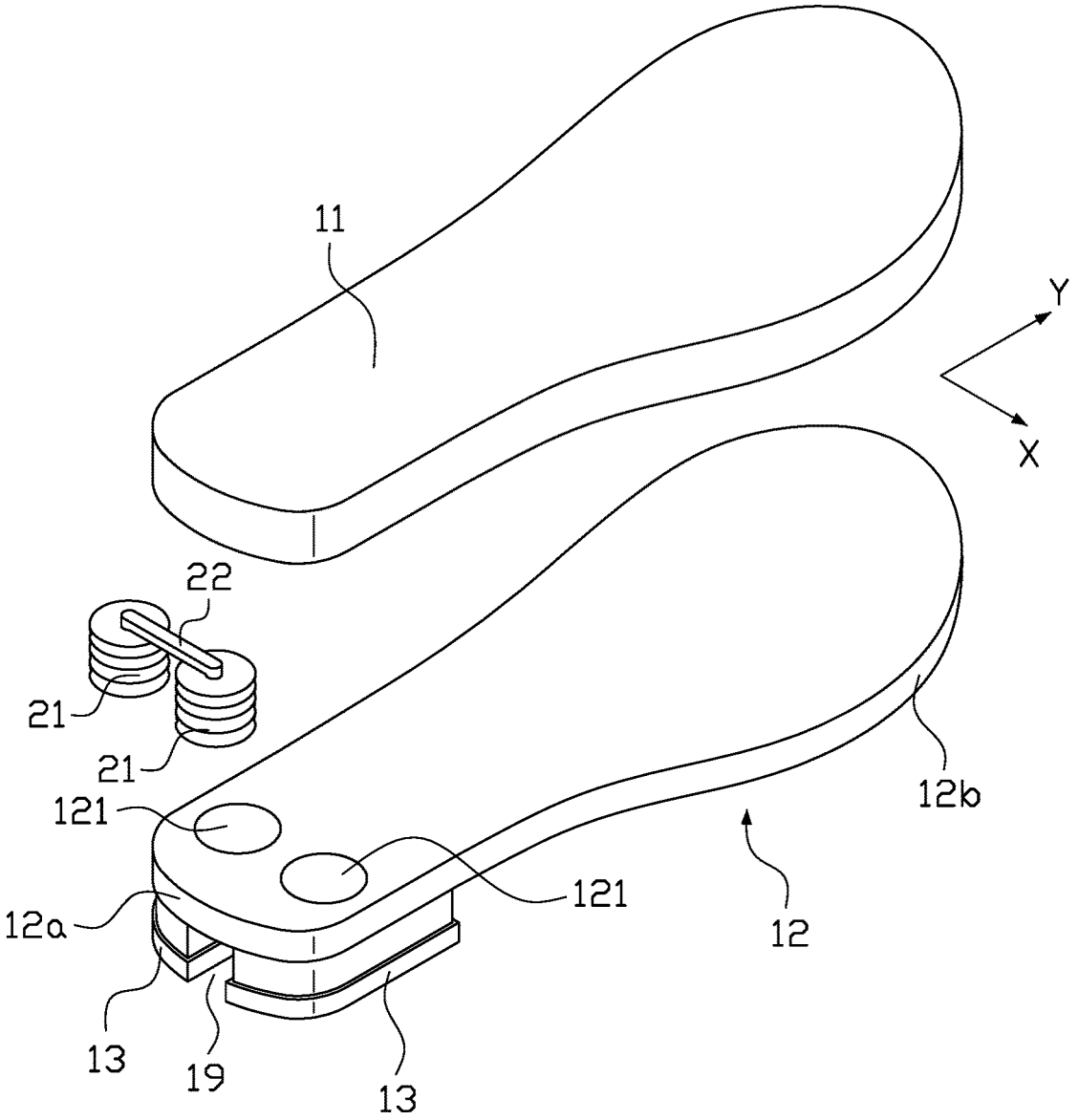
FIG. 8 is an exploded schematic view of the sole structure in embodiment 3 of the present disclosure.
Figure 9:
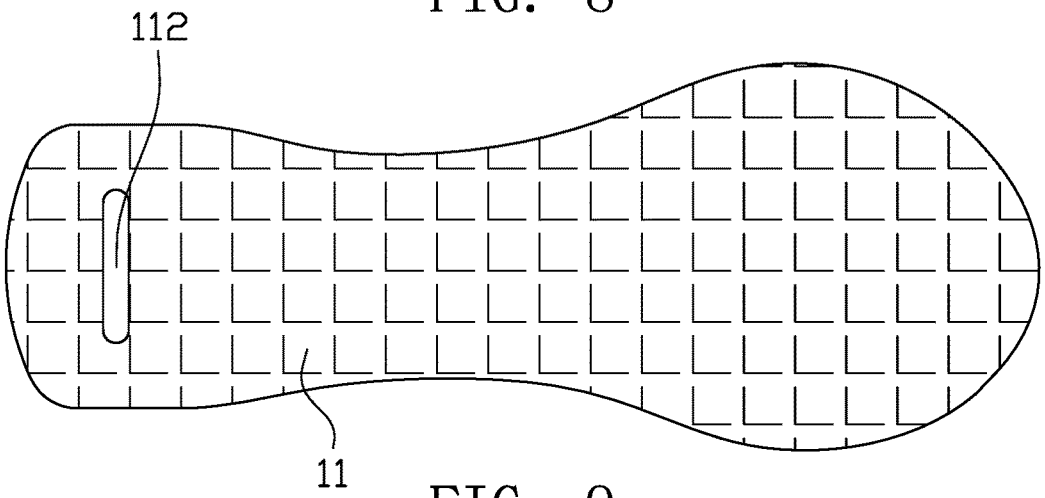
FIG. 9 is a bottom view of the shoe insert of the sole structure in FIG. 8.
Figure 10:
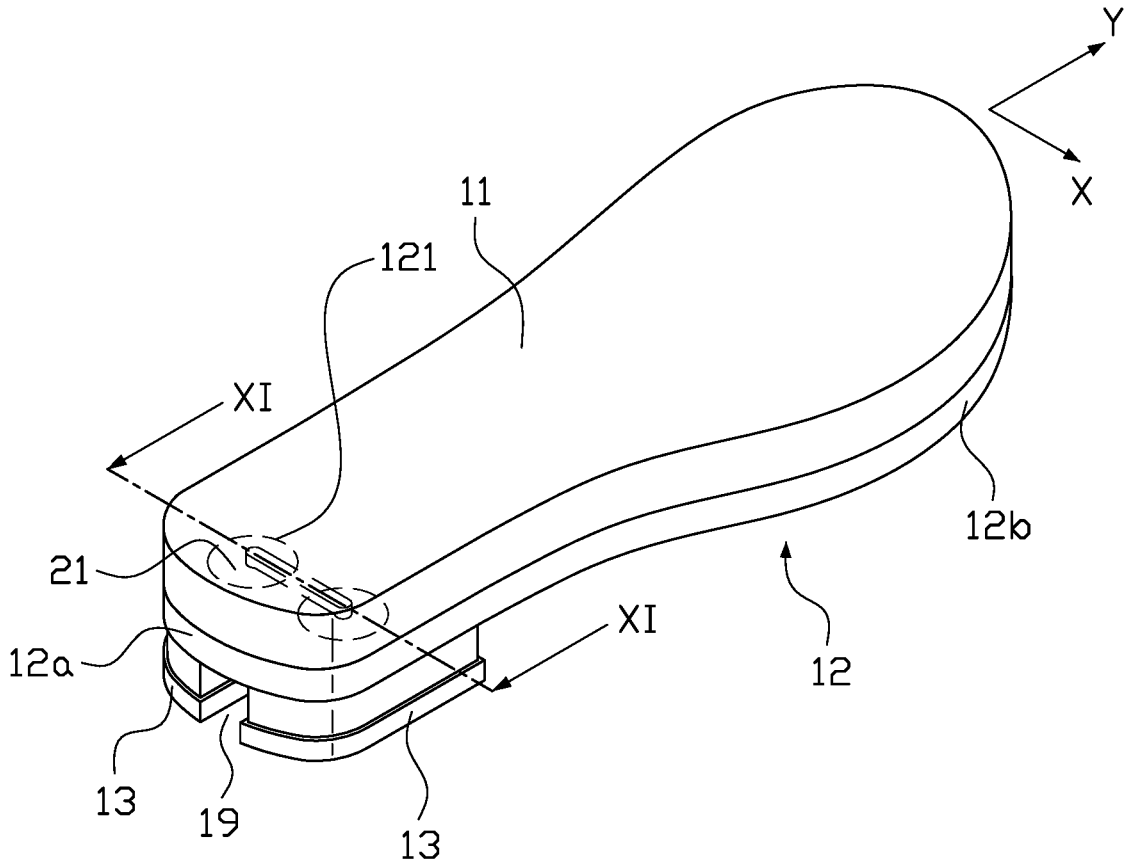
FIG. 10 is an assembled isometric view of the sole structure in FIG. 8.
Figure 11:
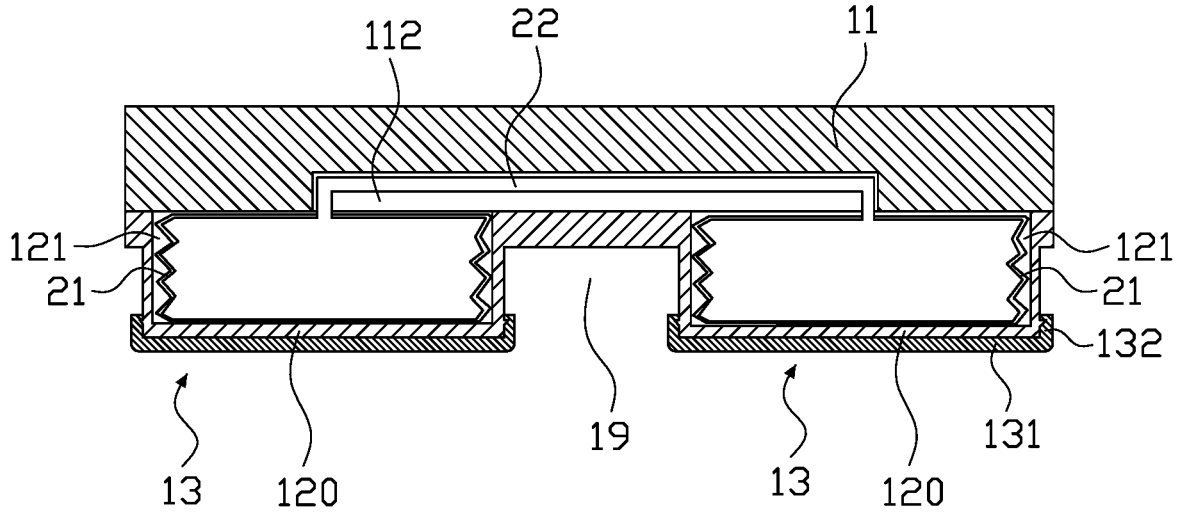
FIG. 11 is a cross sectional view of FIG. 10 along XI-XI direction.

FIG. 8 is an exploded schematic view of the sole structure in embodiment 3 of the present disclosure, FIG. 9 is a bottom view of the shoe insert of the sole structure in FIG. 8, FIG. 10 is an assembled schematic view of the sole structure of FIG. 8, and FIG. 11 is a cross-sectional view of FIG. 10 along XI-XI direction. Please referring to FIGS. 8-11, in this embodiment, every two of the protrusions 120 are arranged in a row along the left-to-right direction of the sole 12 (X direction in FIG. 8), and the airbags 21 in every two protrusions 120 in each row are connected by a connecting tube 22. Specifically, multiple rows of protrusions 120 can be arranged along the fore-and-aft direction (Y direction in FIG. 8) of the sole 12, both protrusions 120 in each row are arranged along the left-and-right direction of the sole 12, and the airbags 12 in protrusions 120 of each row are connected by a connecting tube 22.

During daily exercises, the sole will turn over with a certain angle at the circumstances of walking on rough road, stepping on a stone on the ground or on a foot of others. This will sprain the ankles of the user or even fracture his legs. By arranging interconnected airbags 21 in the protrusions 120 of the sole 12, turning over will be avoided.

Figure 12A:
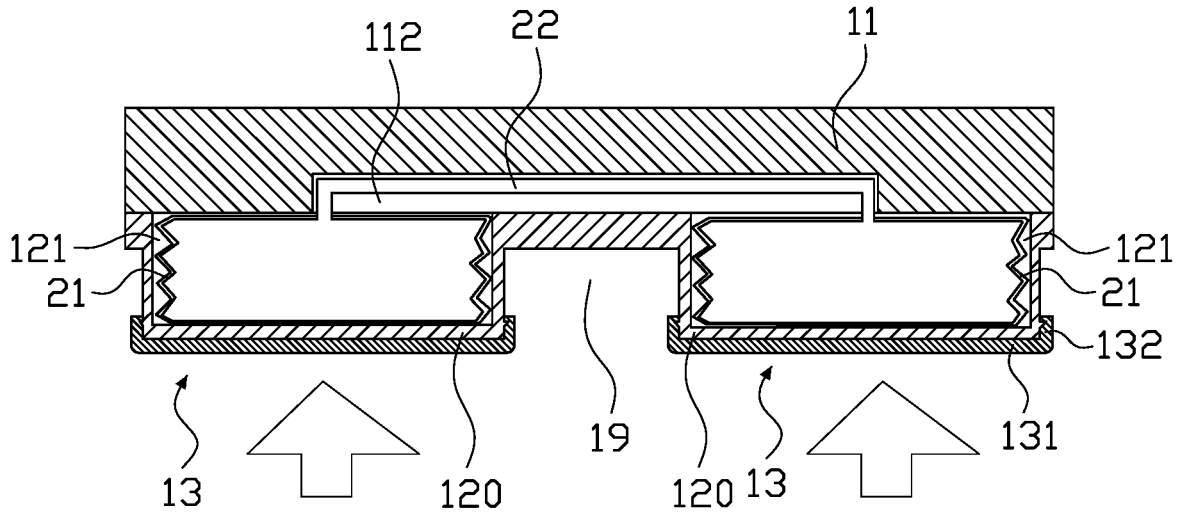
FIGS. 12*a*-12*b* are schematic views of the sole structure of FIG. 11 in different states.
Figure 12B:
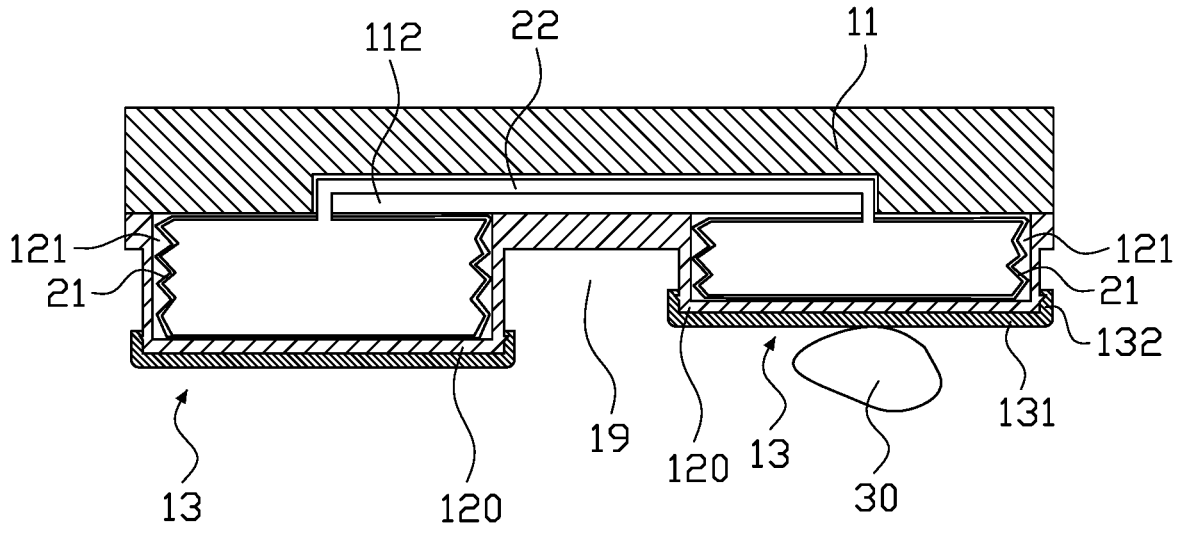

FIGS. 12*a*-12*b* are schematic view of FIG. 11 in different working states, wherein FIG. 12*a* is a schematic view of the airbags in both protrusions during normal compression, and FIG. 12*b* is a schematic view of the airbags in both protrusions when stepping on rough road. As shown in FIG. 12*a*, when walking on a flat road, both airbags in right and left sides bear basically the same load, the air pressure of both airbags 21 are identical, and their deformations are also identical. When one side of the sole steps on an object such as stones, the airbag room 121 at that side is compressed, and the airbag 21 in the airbag room 121 is further compressed. Since both airbags 21 are interconnected, in order to ensure the air pressure in both airbags 21 is identical, the gas in the compressed airbag 21 flows to the airbag in the other side through the connecting tube 22, which makes the airbag 21 in the other side inflate, and the corresponding airbag room 121 is stretched according to the inflation of the airbag 21 at that side and applies force to the ground, which forms a torque contrary to the turning over trend. Because of this, the turning over of the sole 12 is prevented, and the sole 12 keeps relative balance, which can effectively prevent the occurrence of spraining ankles.

In this embodiment, please referring to FIGS. 9 and 11, a connecting tube groove 112 is formed in the bottom surface of the shoe insert 11, which is used to contain the connecting tube 22, and the connecting tube 22 connects the two airbags 21. Since the bottom surface of the shoe insert 11 matches with the upper surface of the sole 12, a connecting tube groove 112 is arranged in the bottom surface of the shoe insert 11, the connecting tube groove 112 can contain the connecting tube 22. Because of this, there is no need to form groove in the sole 12, which can improve the strength of the sole 12.

Embodiment 4

Figure 13:
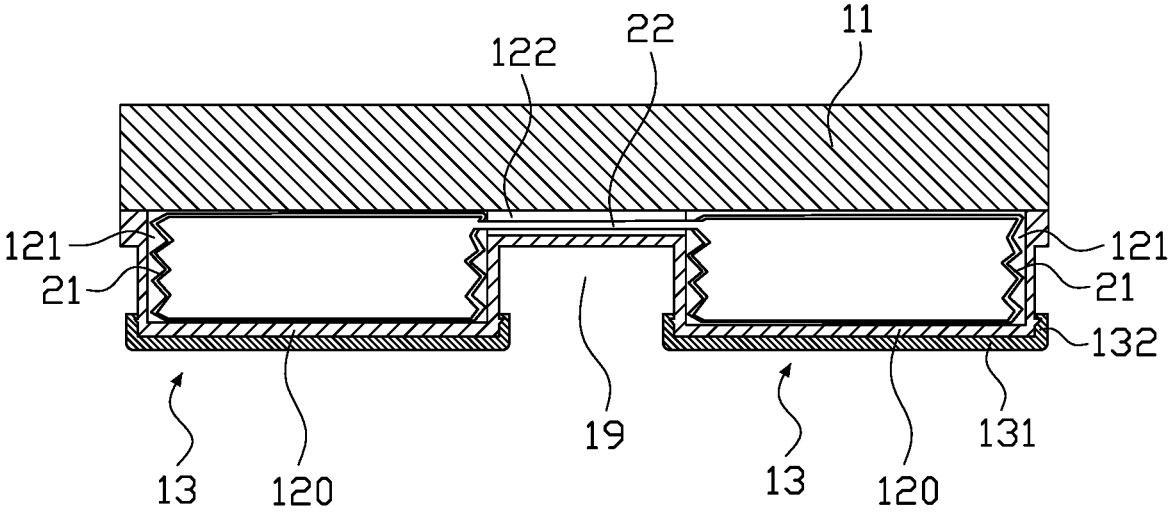
FIG. 13 is a cross sectional view of the sole structure in embodiment 4 of the present disclosure.
Figure 14:
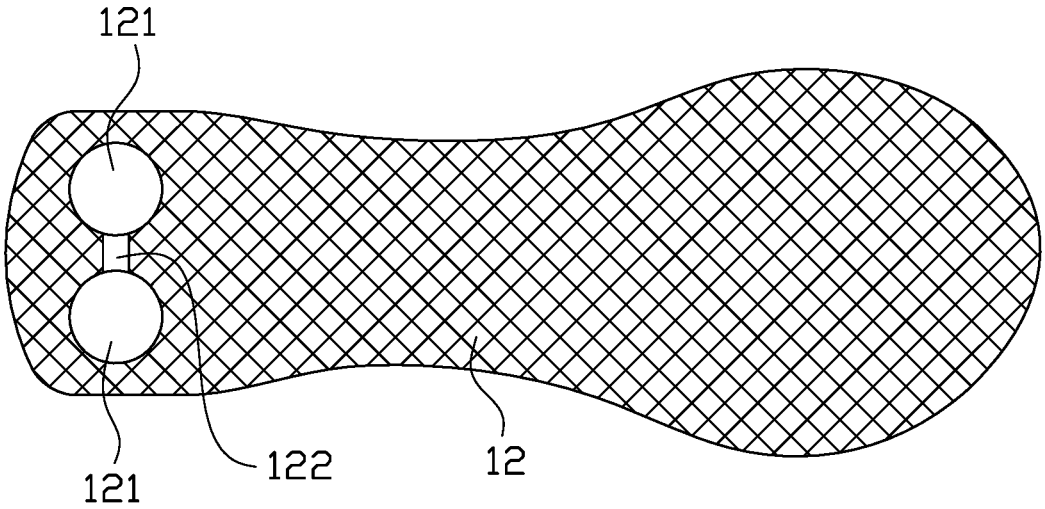
FIG. 14 is a top view of the sole in FIG. 13.

FIG. 13 is a cross-sectional view of the sole structure in embodiment 4 of the present disclosure, and FIG. 14 is a top view of the sole in the sole structure of FIG. 13. Please referring to FIGS. 13 and 14, in this embodiment, a connecting tube groove 122 is arranged on the upper surface of the sole 12, the connecting tube groove 122 is used to contain the connecting tube 22. The connecting tube 22 connects with the two airbags 21. The connecting tube groove 122 is formed on the upper surface of the sole 12, which can facilitate the placing of the airbag 21, and further ensure the placing of the connecting tube 22 even their sizes do not match.

Embodiment 5

Figure 15:
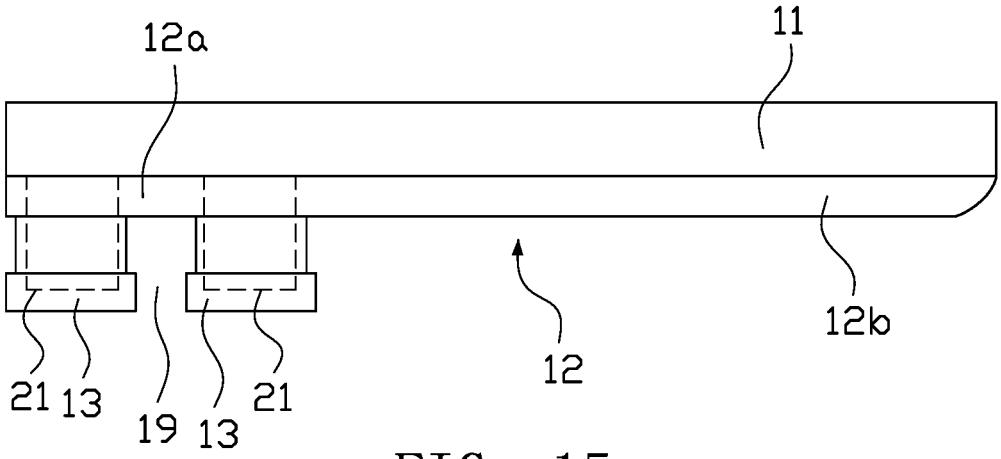
FIG. 15 is a front view of the sole structure in embodiment 5 of the present disclosure.

FIG. 15 is a front view of the sole structure in embodiment 5 of the present disclosure. Please referring to FIG. 15, in this embodiment, the multiple protrusions 120 are merely arranged at the heel part 12*a* of the sole 12, and there is no protrusion 120 arranged at the forefoot part 12*b* of the sole 12. These protrusions 120 at the heel part 12*a* are arranged in rows along the left-to-right direction of the sole 12 (two rows of the protrusions 120 are shown in FIG. 15). Airbag room 121 and airbag 21 are arranged in each of the protrusions 120, and airbags 21 in each row of the two protrusions 120 are further interconnected with each other by a connecting tube 22. The design of this embodiment is suitable for air-cushion shoes with heels.

Embodiment 6

Figure 16:
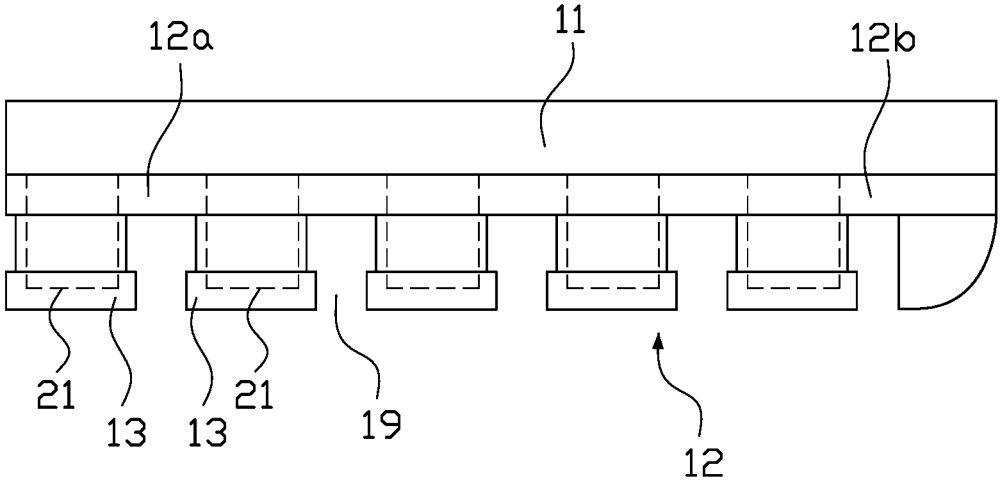
FIG. 16 is a front view of the sole structure in embodiment 6 of the present disclosure.

FIG. 16 is a front view of the sole structure in embodiment 6 of the present disclosure. Please referring to FIG. 16, in this embodiment, these multiple protrusions 120 are distributed at both the heel part 12*a* and the forefoot part 12*b* of the sole 12. These protrusions 120 at the heel part 12*a* and the forefoot part 12*b* are arranged in rows along left-to-right direction (six rows of the protrusions 120 are shown in FIG. 16). An airbag room 121 and an airbag 21 are mounted in each of the protrusions 120, and every two airbags 21 in each row of the protrusions 120 interconnect with each other via a connecting tube 22. The sole structure of the embodiment is suitable for flat air-cushion shoes, which can improve the state of the stress on the feet by distributing the stress onto the whole sole.

Embodiment 7

Figure 17:
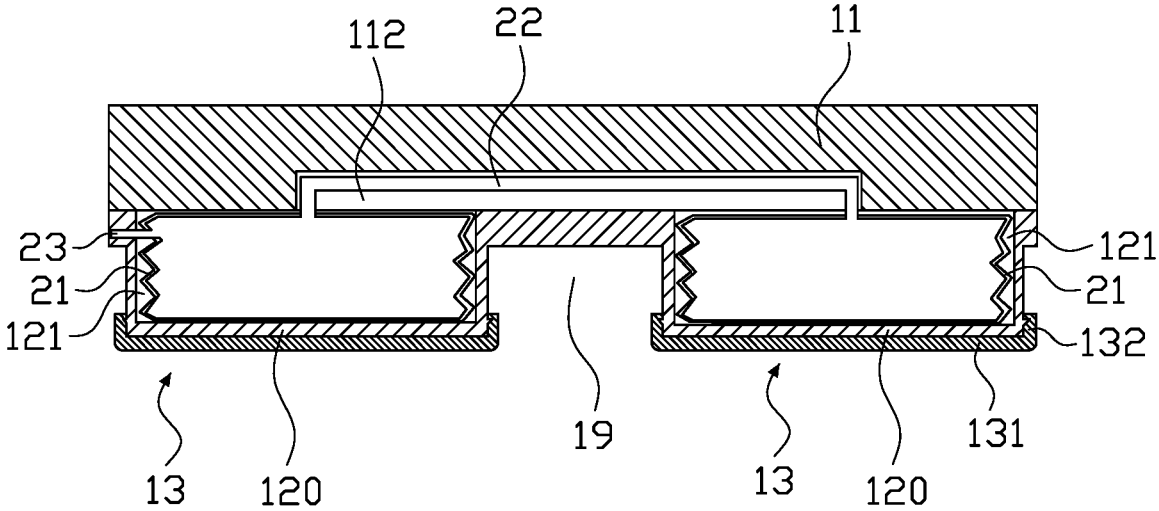
FIG. 17 is a cross sectional view of the sole structure in embodiment 7 of the present disclosure.

FIG. 17 is a cross-sectional view of the sole structure in embodiment 7 of the present disclosure. Please referring to FIG. 17, in this embodiment, the airbag 21 in the protrusion 120 connects with an air vent 23, which is used to inflate the airbag 21. The user can inflate the airbag 21, for example, when walking on hard road, at that circumstance the airbag should be soft; meanwhile, when walking on soft road, the airbag 21 should be hard enough, at that circumstance, the user can adjust the air vent 23 to decrease the gas pressure in the airbag 21. The inflation of the airbag 21 can be conducted through the air vent 23 by a pump or an electric air pump (not shown). When necessary, the deflation of the airbag 21 can be carried out by a long thin object (such as iron wire or toothpick) inserting into the air vent 23, therefore the pressure in the airbag 21 is reduced. The pressure in the airbag 21 changes at the range of 5 psi-25 psi in accordance with specific conditions.

Embodiment 8

Figure 18:
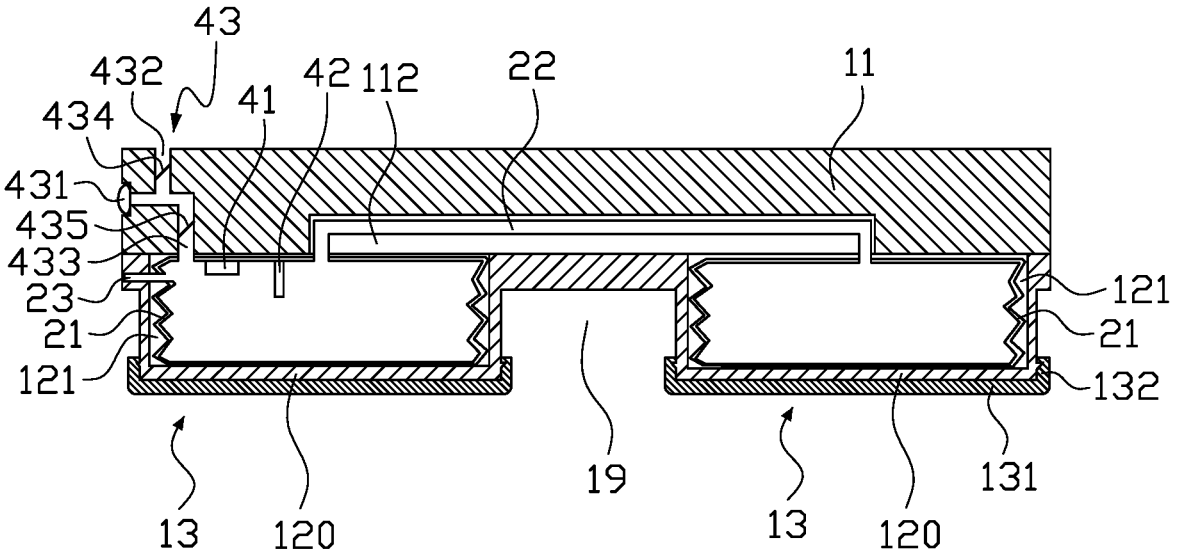
FIG. 18 is a cross sectional view of the sole structure in embodiment 8 of the present disclosure.

FIG. 18 is a cross-sectional view of the sole structure in embodiment 8 of the present disclosure. Please referring to FIG. 18, in this embodiment, the sole structure further includes an air pressure sensor 41 which is used to detect the air pressure in the airbag 21. The air pressure sensor 41 can be simply placed in the airbag 21, and it can also be placed outside the airbag 21 but connected with the airbag 21, in order to detect the air pressure in the airbag 21.

Figure 20:
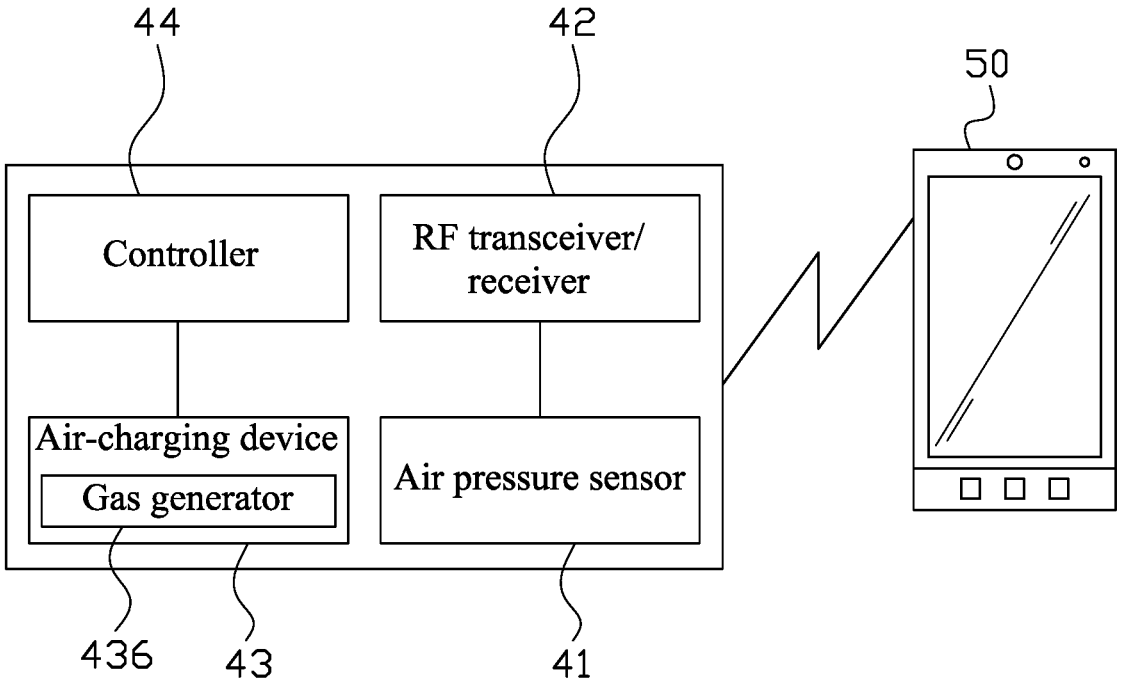
FIG. 20 is a schematic diagram of automatic inflating principle of the sole structure in FIG. 19.

The sole structure further includes a RF transceiver/receiver module 42 used for sending the air pressure value in the airbag 21 detected by the air pressure sensor 41 to the mobile terminal 50 (as shown in FIG. 20) of the user. In this way, the user can easily get the air pressure situation in the airbag 21, and then decide to inflate the airbag 21 through the air vent 23 or deflate the airbag 21 through the air vent 23 when necessary.

The sole structure further includes a built-in air-charging device 43, when the air pressure in the airbag 21 is insufficient, the airbag 21 can be inflated through the built-in air-charging device 43. In this way, the air pressure and hardness of the airbag 21 can be adjusted at any time, which is superior to the solution of inflating by a pump or an electric air pump, at that situation, the user will have to carry a pump or an electric air pump in hand at any time.

In this embodiment, the air-charging device 43 is a manual air-charging device, which includes an air-charging button 431. The airbag 21 is manually inflated by operating the air-charging button 431. Specifically, the manual air-charging device further includes a first air pipe 432, a second air pipe 433, a first valve 434 mounted in the first air pipe 432, and a second valve 435 mounted in the second air pipe 433. The second air pipe 433 connects with the air-charging button 431 and the airbag 21, and the first air pipe 432 connects with the second air pipe 433 and the external environment. The air-charging button 431 is elastic, when the airbag 21 is to be inflated, press the air-charging button 431 to make it compress. At that moment, the first valve 434 in the first air pipe 432 is closed, and the second valve 435 in the second air pipe 433 is open. When pressing, the air-charging button 431 pushes the gas into the airbag 21 through the second air pipe 433. When releasing the air-charging button 431, the first valve 434 in the first air pipe 432 is open, and the second valve 435 in the second air pipe 433 is closed, external gas enters the air-charging button 431 via the first air pipe 432, which makes the air-charging button 431 inflate and restore to the initial state. In this way, repeatedly pressing the air-charging button 431 can help inflate the airbag 21 manually. In this embodiment, the air-charging button 431 is exposed at one side of the sole structure, and the inflation can be realized by fingers. In another embodiment, the air-charging button 431 is mounted under the sole part. At that circumstance, the inflation is realized by pressing the air-charging button 431 by walking feet.

Embodiment 9

Figure 19:
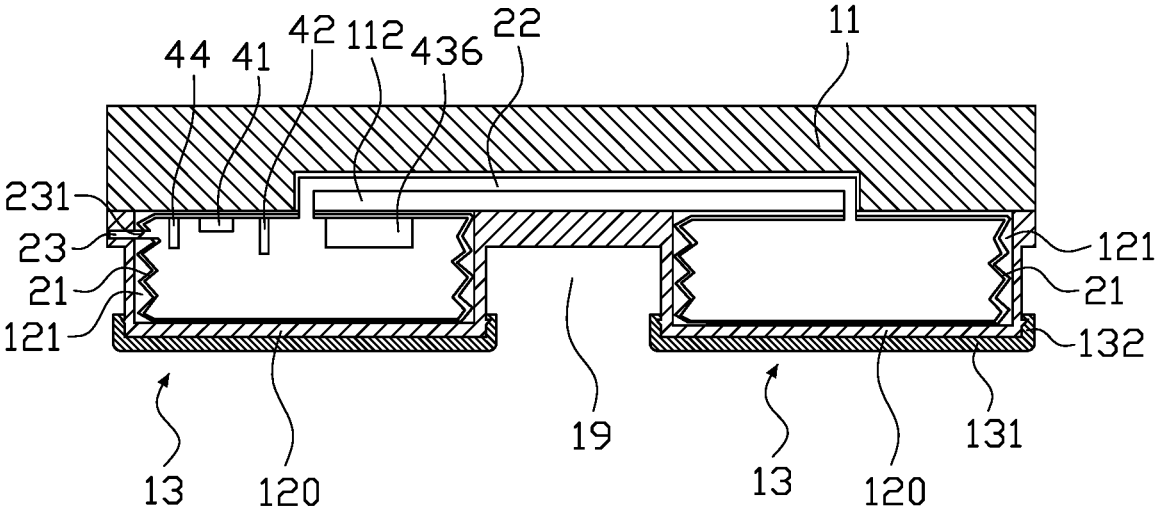
FIG. 19 is a cross sectional view of the sole structure in embodiment 9 of the present disclosure.

FIG. 19 is a cross-sectional view of the sole structure in embodiment 9 of the present disclosure, and FIG. 20 is a schematic view of the automatic air-charging principle of the sole structure in FIG. 19. Please referring to FIGS. 19 and 20, in this embodiment, the sole structure further includes a controller 44, the RF transceiver/receiver 42 is further used to receive the inflation instruction sent from the mobile terminal 50. The air-charging device 43 is an automatic air-charging device, which includes a gas generator 436, such gas generator 436 can be a small or micro-sized gas generator, and can also generate gas by chemical reaction. The gas generator 436 can be placed simply in the airbag 21, and it can also be mounted outside the airbag 21 and introduce the generated gas into the airbag 21 via pipes.

The controller 44 connects with the air charging device 43 and the RF transceiver/receiver 42. When the airbag 21 needs to be inflated, the user can send inflation instruction by the mobile terminal 50, when the RF transceiver/receiver 42 receives the inflation instruction from the mobile terminal 50, it transfers the inflation instruction to the controller 44, the controller 44 controls the gas generator 436 to generate gas, therefore the airbag 21 is automatically inflated until the air pressure of the airbag 21 achieves target value. In this way, the air pressure and hardness of the airbag 21 can be adjusted automatically according to the requirements of the user.

In this embodiment, an electronic-controlled sealing valve 231 is further mounted in the air vent 23, and the sealing valve 231 connects with the controller 44. When air pressure and harness of the airbag 21 are extremely high, the air pressure of the airbag 21 needs to be reduced, the user can issue a deflation instruction via the mobile terminal 50. When the RF transceiver/receiver 42 receives the deflation instruction sent by the mobile terminal 50, it transfers the deflation instruction to the controller 44. And then, the controller 44 controls the sealing valve 231 to open, and extra gas is deflated from the airbag 21 via the air vent 23 until the air pressure in the airbag 21 achieves target value.

In the embodiment, the controller 44 can provide suggested air pressure of the airbag 21 according to the operating condition or road surface condition, and send the suggested air pressure to the mobile terminal 50 of the user via the RF transceiver/receiver 42. The user can easily decide whether it is needed to inflate or deflate the airbag 21 based on the suggested air pressure and the current air pressure in the airbag 21.

The sole structure provided by the aforementioned embodiments can be applied in various shoes such as sports shoes, basketball shoes, running shoes, casual shoes or feather shoes.

The sole structure provided by the aforementioned embodiments of the present disclosure have at least the following advantages:

First, the airbag room and the airbag mounted in the sole structure form a shock absorption system, which endows the sole structure a better shock absorption effect. Further, by mounting an air-charging device in the sole structure, when the air pressure in the airbag is insufficient, the airbag can be inflated through the built-in air-charging device. In this way, the air pressure and hardness of the airbag can be adjusted at any time in order to adapt to different road conditions and improve the wear comfort.

Second, when the two airbags in the same row are connected by a connecting tube, it can balance the sole structure, even walking on an uneven road, the user will not sprain his ankles.

Third, by setting a removable anti-wear block on the sole, a modular sole structure is formed, when the anti-wear block is worn out, a new anti-wear block can be replaced. In this way, the user can fine adjust his walking posture timely, and thus reduce the worn out of the sole structure. Because of this, the life-span of the shoes is prolonged, and the undesirable walking posture caused by the worn out of the sole can be avoided; by replacing the removable anti-wear block, the user will not have to frequently replace new shoes and economic loss is avoided.

While the present disclosure has been described in terms of what is presently considered to be the most practical and preferred embodiments, it is to be understood that the present disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inflatable shock-absorbing sole structure, comprising a sole and at least one protrusion arranged in the sole, wherein an airbag room is formed in the protrusion, and an airbag is arranged in the airbag room, the protrusion and the airbag are stretchable and compressible, the shock-absorbing sole structure further comprises a built-in air-charging device, when the airbag needs to be inflated, the airbag is inflated through the built-in air-charging device;

wherein the air-charging device is a manual air-charging device, the manual air-charging device comprises an air-charging button, a first air pipe, a second air pipe, a first valve mounted in the first air pipe, and a second valve mounted in the second air pipe, the second air pipe connects with the air-charging button and the airbag, the first air pipe connects with the second air pipe and is adapted to extend to an external environment, the air-charging button is elastic, and the airbag is manually inflated by operating the air-charging button;

when the airbag is to be inflated, the air-charging button is pressed, the first valve in the first air pipe is closed, and the second valve in the second air pipe is open, so that the air-charging button pushes the gas into the airbag through the second air pipe;

when the air-charging button is released, the first valve in the first air pipe is open, and the second valve in the second air pipe is closed, external gas enters the air-charging button via the first air pipe, so as to make the air-charging button inflate and restore to its initial state.

2. The shock-absorbing sole structure of claim 1, wherein the air-charging button is exposed at one side of the shock-absorbing sole structure.

3. The shock-absorbing sole structure of claim 1, wherein the shock-absorbing sole structure further comprises a pressure sensor used for detecting a gas pressure in the airbag.

4. The shock-absorbing sole structure of claim 3, wherein the shock-absorbing sole structure further comprises a RF transceiver/receiver module, used for sending an air pressure value in the airbag detected by the air pressure sensor to a mobile terminal of a user.

5. The shock-absorbing sole structure of claim 4, wherein the shock-absorbing sole structure further comprises a controller which connects with the RF transceiver/receiver module, the controller provides suggested air pressure of the airbag according to the operating condition or road surface condition, and sends the suggested air pressure to the mobile terminal of the user via the RF transceiver/receiver module.

6. The shock-absorbing sole structure of claim 1, wherein the airbag connects with an air vent, which is used to inflate the airbag or release gas from the airbag.

7. The shock-absorbing sole structure of claim 1, wherein there are multiple protrusions, every two protrusions are arranged in a row along the left-to-right direction of the sole, and airbags in every two protrusions in each row are connected by a connecting tube.

8. The shock-absorbing sole structure of claim 7, wherein the shock-absorbing sole structure further comprises a shoe insert placed on the sole, a connecting tube groove is arranged in the bottom surface of the shoe insert, the connecting tube groove is used to contain the connecting tube.

9. The shock-absorbing sole structure of claim 7, wherein a connecting tube groove is arranged in the upper surface of the sole, the connecting tube groove is used to contain the connecting tube.

10. The shock-absorbing sole structure of claim 7, wherein the multiple protrusions are separated from each other by spaces.

11. The shock-absorbing sole structure of claim 7, wherein the multiple protrusions are merely arranged at a heel part of the sole.

12. The shock-absorbing sole structure of claim 7, wherein the multiple protrusions are distributed at both the heel part and the forefoot part of the sole.

13. The shock-absorbing sole structure of claim 1, wherein an anti-wear block, which is removable and matches with the protrusion, is mounted on the bottom surface of the protrusion and adapted to be near the ground.

14. The shock-absorbing sole structure of claim 13, wherein the anti-wear block comprises an anti-wear pad and fixing fins, the anti-wear pad is adapted to contact with the ground, the fixing fins are placed at a periphery of the anti-wear pad and connected with the anti-wear pad, the anti-wear block is removably fixed onto the protrusion via the fixing fins.

* * * * *